US009812280B2

(12) United States Patent
Nakagawa et al.

(10) Patent No.: US 9,812,280 B2
(45) Date of Patent: Nov. 7, 2017

(54) MANUFACTURING METHOD OF HIGH-PRESSURE DISCHARGE LAMP AND SEALED PART STRUCTURE FOR HIGH-PRESSURE DISCHARGE LAMP

(71) Applicant: Phoenix Electric Co., Ltd., Himeji-shi, Hyogo (JP)

(72) Inventors: Atsuji Nakagawa, Himeji (JP); Hiroshi Takahashi, Himeji (JP); Takashige Yamada, Himeji (JP)

(73) Assignee: PHOENIX ELECTRIC CO., LTD., Hyogo (JP)

( * ) Notice: Subject to any disclaimer, the term of this patent is extended or adjusted under 35 U.S.C. 154(b) by 178 days.

(21) Appl. No.: 14/747,459

(22) Filed: Jun. 23, 2015

(65) Prior Publication Data

US 2016/0013008 A1 Jan. 14, 2016

(30) Foreign Application Priority Data

Jul. 12, 2014 (JP) ..... 2014-143755

(51) Int. Cl.
*H01J 9/32* (2006.01)
*H01J 61/36* (2006.01)
(Continued)

(52) U.S. Cl.
CPC ..... *H01J 9/326* (2013.01); *H01J 61/368* (2013.01); *H01J 9/247* (2013.01); *H01J 61/86* (2013.01)

(58) Field of Classification Search
CPC ..... H01J 9/326; H01J 61/368; H01J 61/86; H01J 9/247
See application file for complete search history.

(56) References Cited

U.S. PATENT DOCUMENTS 6,600,266 B1 7/2003 Nakagawa
2002/0021092 A1* 2/2002 Seki ..... H01J 61/368 313/623
2010/0171421 A1* 7/2010 Nakagawa ..... H01J 61/822 313/623

FOREIGN PATENT DOCUMENTS

CN 101770929 A 7/2010
JP 2001023570 A 1/2001

OTHER PUBLICATIONS

Notice of First Office Action dated Dec. 15, 2016 from the corresponding Chinese Application No. CN 2016121201556410; English translation of Notice of First Office Action ; Total of 9 pages.

* cited by examiner

*Primary Examiner* — Donald Raleigh
*Assistant Examiner* — Kevin Quarterman
(74) *Attorney, Agent, or Firm* — Lucas & Mercanti, LLP

(57) ABSTRACT

A method of manufacturing a high-pressure discharge lamp, comprising the steps of: inserting a mount into an interior of a glass tube having an outer diameter smaller than an inner diameter of an end part of a sealed container; radially constricting the glass tube at a first position located away from a metallic foil toward a tip of an electrode; sealing the mount by a region of the glass tube that ranges from the first position to at least the other end of the metallic foil; protruding the electrode out of the glass tube located away from the first position toward the tip of the electrode to form a glass-tube air-tightly sealed mount; inserting the sealed mount into the end part of the sealed container; and radially constricting the end part of the sealed container to sealing the glass tube of the sealed mount by the end part.

8 Claims, 12 Drawing Sheets

(51) Int. Cl.

| | |
|---|---|
| *H01J 9/24* | (2006.01) |
| *H01J 61/86* | (2006.01) |

MANUFACTURING METHOD OF HIGH-PRESSURE DISCHARGE LAMP AND SEALED PART STRUCTURE FOR HIGH-PRESSURE DISCHARGE LAMP

CROSS REFERENCE TO RELATED APPLICATION

This application claims the priority of Japanese Patent Application No. 2014-143755 filed on Jul. 12, 2014, which is incorporated by reference herein.

BACKGROUND OF THE INVENTION

Field of the Invention

The present invention relates to a method of manufacturing a high-pressure discharge lamp and a sealed part structure for a high-pressure discharge lamp, whereby pressure proof performance in the internal space of the high-pressure discharge lamp can be enhanced.

Background Art

A high-pressure discharge lamp has been widely used for a projector and so forth, and is characterized in that quite a large amount of light is obtainable from a single high-pressure discharge lamp. The high-pressure discharge lamp is generally composed of a sealed container made of silica glass and a pair of mounts. Each mount is composed of an electrode, a metallic foil and an external lead rod. Each mount is formed by welding the electrode to one end of the metallic foil and by welding the external lead rod to the other end of the metallic foil.

The pair of mounts is inserted into the sealed container such that the electrodes thereof are opposed to each other. Then, the mounts are air-tightly sealed by the both end parts of the sealed container. Thus, the both end parts of the sealed container are formed as a pair of sealed parts, while a luminous tube part is formed between the pair of sealed parts. The luminous tube part herein has an internal space in which the paired electrodes are disposed in opposition to each other.

Mercury is encapsulated in the internal space. When high voltage is applied to the pair of mounts, an arc discharge is generated. Accordingly, evaporated mercury is excited and emits light.

The high-pressure discharge lamp is enhanced in luminous efficiency (a luminous amount per electric power to be supplied to the high-pressure discharge lamp) by increasing the pressure of the internal space in lighting. Therefore, it is an important challenge to enhance the pressure proof performance of the sealed parts of the sealed container in the high-pressure discharge lamp. Technologies have been conventionally developed for enhancing the pressure proof performance of the sealed parts (e.g., see Japan Laid-open Patent Application Publication No. JP-A-2001-23570).

In the technology disclosed in the Publication No. JP-A-2001-23570, the pair of mounts, in each of which the metallic foil has been preliminarily covered with a glass tube, is used for enhancing the pressure proof performance of the sealed parts. With use of the mounts as described above, sealing of each mount by the sealed container is conducted between glass members, i.e., the glass tube and the end part of the sealed container. Thus, highly airtight fusion can be achieved in comparison with sealing between different types of materials, i.e., glass and metal. Consequently, the pressure proof performance of the sealed parts can be enhanced.

SUMMARY OF THE INVENTION

In recent years, further enhancement in luminous efficiency of the high-pressure discharge lamp has been demanded, and accordingly, it has been required to further increase the pressure in the internal space of the luminous tube part in lighting. However, it has been revealed that in attempting to achieve further increase in pressure of the internal space as described above, the technology disclosed in the Publication No. 2001-23570 (hereinafter simply referred to as "a related art") also has a drawback hindering the attempt.

Specifically in the related art, when a mount with glass-tube 4 is manufactured, as shown in FIG. 12, a mount 1 is inserted into a glass tube 2, and then, the glass tube 2 is externally heated at a region thereof corresponding to a metallic foil 3 so as to air-tightly seal the metallic foil 3 by the region of the glass tube 2. Afterwards, a pressure proof performance test is conducted, and unnecessary parts of the glass tube 2 are cut off.

As shown in FIG. 13, the mount with glass-tube 4 formed as described above is inserted into an end part of a sealed container 5, and the glass tube 2 of the mount with glass-tube 4 is air-tightly sealed by the sealed container 5 (see FIG. 14). At this time, as shown in FIG. 15, there is a large difference between the diameter (D1) of the electrode-side end of the glass tube 2 and the diameter (D2) of a shaft part of an electrode P. Hence, an edge 6 (an internal corner) is formed between the tip end surface of the glass tube 2 and the inner surface of the sealed container 5. There has been a possibility that when the pressure of an internal space 8 of a luminous tube part 7 becomes high, the sealed part 9 is damaged or broken at the edge 6 as a structural origin of damage or breakage and the airtightness thereof is lost. In other words, there has been a possibility that the edge 6 could be a defective part of the high-pressure discharge lamp in terms of pressure proofing.

The present invention has been developed in view of the aforementioned drawback of the related art. Therefore, it is a main object of the present invention to provide a high-pressure discharge lamp whereby an edge (an internal corner) is unlikely to be formed in fabricating the high-pressure discharge lamp with use of a mount with glass-tube so as to enhance the pressure proof performance of the high-pressure discharge lamp as much as possible.

According to an aspect of the present invention, a method of manufacturing a high-pressure discharge lamp is provided. The method includes the steps of:

- forming a mount including a metallic foil, an electrode and an external lead rod by welding the electrode to one end of the metallic foil and welding the external lead rod to the other end of the metallic foil;
- inserting the mount into an interior of a glass tube having an outer diameter smaller than an inner diameter of an end part of a sealed container;
- radially constricting the glass tube at a first position located away from the metallic foil toward a tip of the electrode;
- air-tightly sealing the mount by a region of the glass tube, the region ranging from the first position to at least the other end of the metallic foil;
- protruding the electrode out of the glass tube located away from the first position toward the tip of the electrode so as to form a glass-tube air-tightly sealed mount;
- inserting the glass-tube air-tightly sealed mount into the end part of the sealed container such that the tip of the electrode is inserted first; and radially constricting the end part so as to air-tightly sealing the glass tube of the glass-tube air-tightly sealed mount by the end part.

The step of radially constricting the glass tube preferably results in formation of a smooth tapered surface on an electrode-side end part of the glass tube air-tightly sealing the glass-tube air-tightly sealed mount.

In the step of radially constricting the glass tube, the glass tube is preferably heated at the first position and is pulled to longitudinally opposite sides centering on the first position.

The sealed container preferably has a pair of end parts and an intermediate part that is formed between the end parts and has a larger outer contour (outer diameter) than the end parts, and boundary parts between the end parts and the intermediate part in the sealed container preferably respectively have an outer contour more thinly constricted than the end parts.

Moreover, it is preferable to use the sealed container that the boundary parts respectively have a smaller thickness than the remaining part of the sealed container.

Moreover, the boundary parts of the sealed container are preferably respectively more reduced in thickness than the remaining part of the sealed container by heating the boundary parts and pulling the sealed container to longitudinally opposite sides at each of the boundary parts.

Moreover, in the step of radially constricting the end part of the sealed container so as to air-tightly sealing the glass tube of the glass-tube air-tightly sealed mount by the end part, the sealed container is preferably radially constricted to the intermediate part across the boundary part.

According to another aspect of the present invention, a sealed part structure for a high-pressure discharge lamp is provided. The high-pressure discharge lamp includes a luminous tube part and a sealed part, and the sealed part is embedded with a glass tube including a metallic foil in an interior thereof. One end of the metallic foil is attached to an electrode, and a tip of the electrode is introduced into the luminous tube part. The other end of the metallic foil is attached to an external lead rod, and the external lead rod is extended out of the sealed part. The sealed part structure is characterized in that before being embedded in the sealed part, the glass tube is radially constricted at a first position located away from the metallic foil toward the tip of the electrode and thereafter the metallic foil is air-tightly sealed by the glass tube.

According to the present invention, in forming the glass-tube air-tightly sealed mount, the glass tube is configured to be radially constricted preliminarily, and thereafter, the mount is configured to be air-tightly sealed by the glass tube. With the configuration, the diameter of the electrode-side end of the glass tube in the glass-tube air-tightly sealed mount becomes more similar to the diameter of the shaft part of the electrode. In other words, a smaller step is produced between the exposed surface of the electrode and the electrode-side end of the glass tube. Thus, when the glass-tube air-tightly sealed mount is inserted into and air-tightly sealed by the sealed container, an edge (an internal corner) is unlikely to be produced between the electrode-side end surface of the glass tube and the inner surface of the sealed container. Consequently, it is possible to obtain a high-pressure discharge lamp that can be lit at a higher pressure by reducing a possibility of producing an edge that could be a defective part of the high-pressure discharge lamp in terms of pressure proofing.

BRIEF DESCRIPTION OF THE DRAWINGS

Referring now to the attached drawings which form a part of this original disclosure.

DETAILED DESCRIPTION OF EMBODIMENTS (Structure of High-Pressure Discharge Lamp 10)

Figure 1:
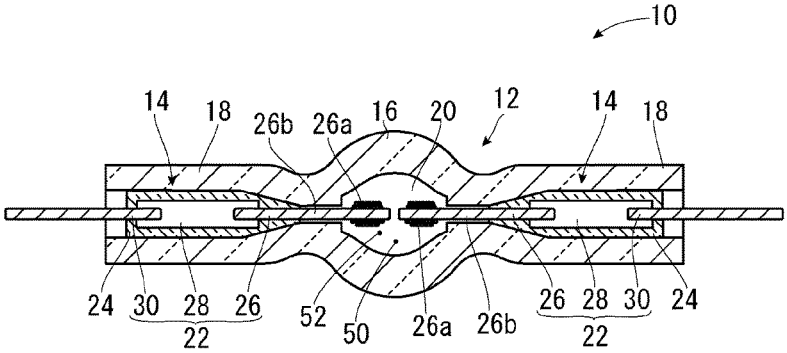
FIG. 1 is a cross-sectional view of an exemplary high-pressure discharge lamp to which the present invention is applied.

An embodiment of a high-pressure discharge lamp 10 manufactured by a method according to the present invention will be hereinafter explained. As shown in FIG. 1, the high-pressure discharge lamp 10 includes a sealed container 12 and a pair of glass-tube air-tightly sealed mounts 14.

The sealed container 12 includes a luminous tube part 16 and a pair of sealed parts 18 that outwardly extend from the luminous tube part 16. The luminous tube part 16 and the sealed parts 18 are integrally made of silica glass. An internal space 20 is produced in the interior of the luminous tube part 16, and is sealed by the sealed parts 18. Additionally, the glass-tube air-tightly sealed mounts 14 are respectively buried in the sealed parts 18. Moreover, a predetermined amount of mercury 50 and a predetermined amount of halogen 52 (e.g., bromine) are encapsulated in the internal space 20.

Each glass-tube air-tightly sealed mount 14 includes a mount 22 and a glass tube 24. The mount 22 includes an electrode 26, a metallic foil 28 and an external lead rod 30. The glass tube 24 air-tightly seals the mount 22 so as to cover the entirety of the metallic foil 28, a part of the electrode 26 and a part of the external lead rod 30 in the mount 22.

The electrode 26 is a thin rod-shaped member made of tungsten. One end thereof is physically/electrically connected to one end of the metallic foil 28 by means of welding or so forth, whereas the other end thereof protrudes into the internal space 20 in the luminous tube part 16 of the sealed container 12. Additionally, the other ends of a pair of the electrodes 26 are disposed in opposition to each other in the internal space 20. It should be noted that in the present embodiment, each electrode 26 has a tungsten wire wound about the tip thereof and thus has a large diameter. In the present specification, the large diameter part of each electrode 26 will be referred to as an electrode part 26*a* whereas the other part of each electrode 26 will be referred to as a shaft part 26*b*.

The metallic foil 28 is a thin plate member made of molybdenum and has a strip shape. As described above, one end of the electrode 26 is connected to one end of the metallic foil 28, whereas one end of the external lead rod 30 is physically/electrically connected to the other end of the metallic foil 28.

The external lead rod 30 is a member made of electrically conductive material and has a thin rod shape. As described above, one end thereof is connected to the metallic foil 28, whereas the other end thereof protrudes outward.

When a voltage having a predetermined high value is applied to the pair of external lead rods 30 mounted to the high-pressure discharge lamp 10, a glow discharge starts between the pair of the electrodes 26 disposed in the internal space 20 of the luminous tube part 16 (more accurately, between the electrode parts 26*a*). Then, the glow discharge transitions to an arc discharge. The mercury 50 is evaporated/excited by the arc and emits light.

(Method of Manufacturing High-Pressure Discharge Lamp 10)

Figure 2:
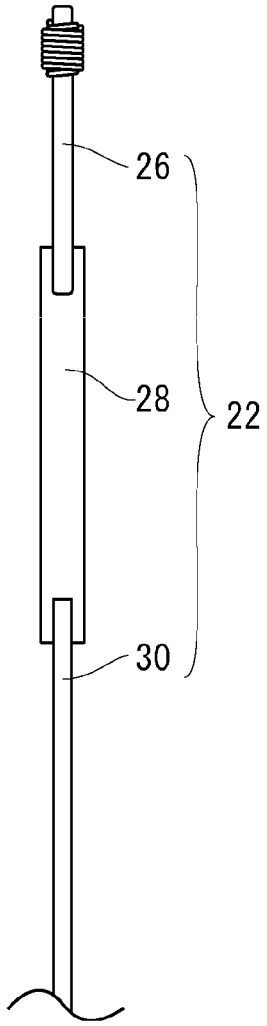
FIG. 2 is a diagram for explaining an exemplary method of manufacturing the high-pressure discharge lamp to which the present invention is applied.

Next, a method of manufacturing the high-pressure discharge lamp 10 according to the present embodiment will be explained. Firstly, as shown in FIG. 2, one end of each electrode 26 is welded to one end of each metallic foil 28, and simultaneously, one end of each external lead rod 30 is welded to the other end of each metallic foil 28. Each mount 22 is thus formed.

Figure 3:
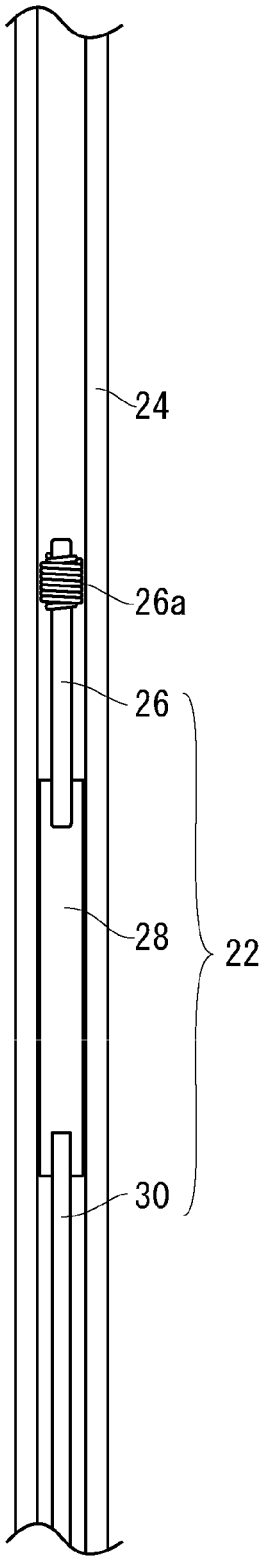
FIG. 3 is a diagram for explaining the exemplary method of manufacturing the high-pressure discharge lamp to which the present invention is applied.

Afterwards, as shown in FIG. 3, each mount 22 is inserted into each glass tube 24 that the outer diameter thereof is smaller than the inner diameter of each end part of the sealed container 12. It should be noted that the thickness of each glass tube 24 is thinner than that of each end part (to be formed as each sealed part 18) of the sealed container 12.

Figure 4:
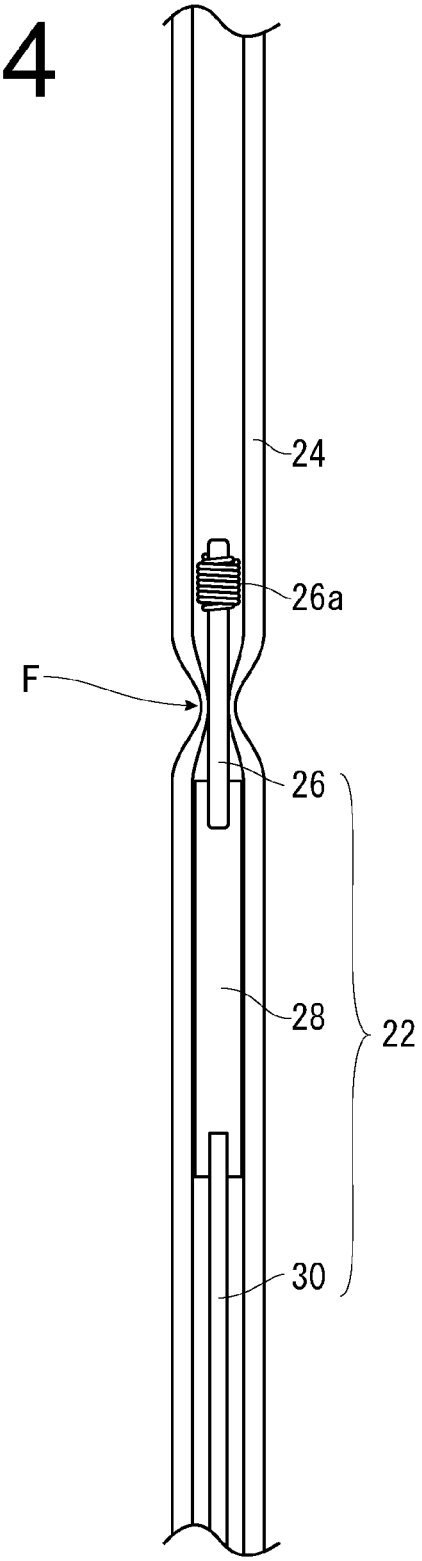
FIG. 4 is a diagram for explaining the exemplary method of manufacturing the high-pressure discharge lamp to which the present invention is applied.

After each mount 22 is inserted into each glass tube 24 and the interior of each glass tube 24 is set at a negative pressure, as shown in FIG. 4, each glass tube 24 is radially constricted at a first position F. The first position F is spaced from each metallic foil 28 toward the tip (the electrode part 26*a*) of each electrode 26. Specifically, each glass tube 24 is heated at the first position F by a burner, a heater or so forth, and the glass tube 24 is softened at the position. After softened, each glass tube 24 is pulled (in the up and down directions in FIG. 4) centering on the first position F so as to be radially constricted (shrank) at the first position F. It should be noted that the method of radially constricting each glass tube 24 is not limited to the above. Alternatively, after heated at the first position F, each glass tube 24 may be squeezed (pinched) at the first position F by an externally applied force. Yet alternatively, as a method of radially constricting each glass tube 24, it can be assumed to sandwich each glass tube 24 with molds designed to produce each glass tube 24 having a radially constricted shape after heating of each glass tube 24, to press a roller onto each glass tube 24 at the first position F, to make each glass tube 24 shrink by heating, or to cut each glass tube 24 by machining.

Figure 5:
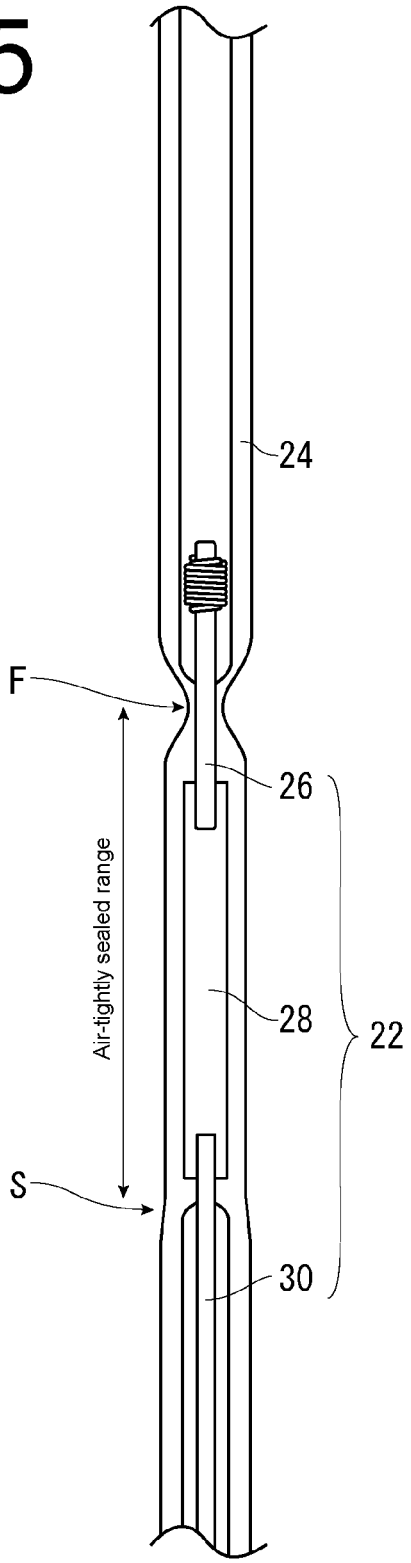
FIG. 5 is a diagram for explaining the exemplary method of manufacturing the high-pressure discharge lamp to which the present invention is applied.

As shown in FIG. 5, after each glass tube 24 is radially constricted, each mount 22 is air-tightly sealed by a region of each glass tube 24, i.e., a region ranging from the first position F to each external lead rod 30 (more accurately, to a second position S located away from each metallic foil 28 toward the tip side (the other end side) of each external lead rod 30). Specific examples of airtight sealing methods herein assumed include "shrink seal technique" for shrinking each glass tube 24 by heating an air-tightly sealing part, "pinch seal technique" for flattening an air-tightly sealing part by heating and pinching the air-tightly sealing part, and so forth. It should be noted that an oxide film may be preliminarily formed on the surface of each metallic foil 28 in order to enhance adhesiveness between each glass tube 24 and each metallic foil 28 in airtight sealing.

Figure 6:
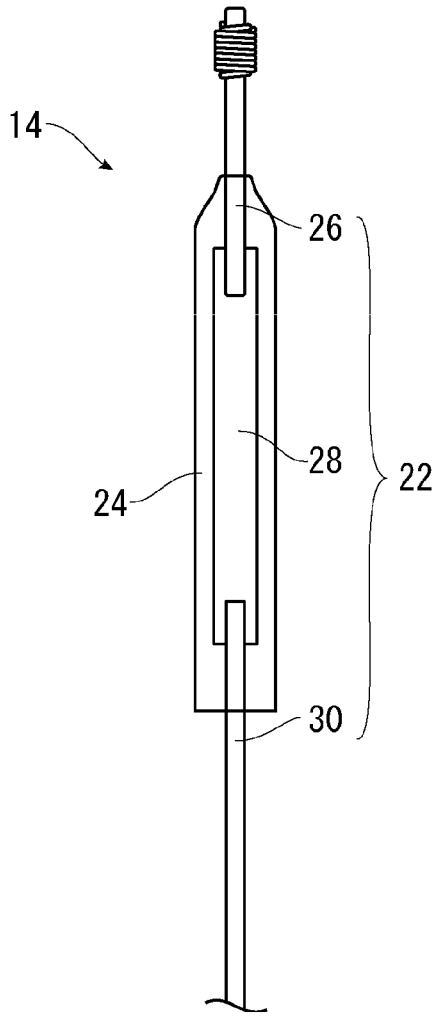
FIG. 6 is a diagram for explaining the exemplary method of manufacturing the high-pressure discharge lamp to which the present invention is applied.

After each mount 22 is air-tightly sealed by each glass tube 24, each glass tube 24 is cut at the first position F as shown in FIG. 6. Thus, each electrode 26 outwardly protrudes from the first position F. Additionally, each glass tube 24 is cut by a diamond cutter or so forth at an appropriate position closer to the tip end (the other end) of each external lead rod 30 than the second position S such that each external lead rod 30 protrudes from each glass tube 24. Based on the above, fabrication of each glass-tube air-tightly sealed mount 14 is completed. It should be noted that according to the manufacturing method of the present embodiment, each glass tube 24 is radially constricted, and then, the radially constricted part thereof is cut. Thus, an area to be cut is smaller than that of conventional glass tubes. Due to this, a crack or missing of glass is unlikely to occur in the cutting part. Additionally, due to the cutting area smaller than that of conventional glass tubes, vibrations and shocks are reduced in cutting, and hence, it is possible to approximately solve a trouble of bending or snapping of an electrode that has conventionally occurred at a probability of 10 to 20%. Moreover, in the present embodiment, it is possible to employ non-contact laser cutting or so forth not a contact-type cutting method using such as a cutter. In trying to laser cut a radially non-constricted glass tube just like a conventional glass tube, a drawback has been produced that due to the large diameter of the glass tube, quite large energy is required and the glass tube cannot be easily cut in a tapered shape. However, when radially constricted, a glass tube can be easily cut with less energy. Additionally, shocks are not generated in cutting. Hence, cracks are further unlikely to be produced.

Figure 7:
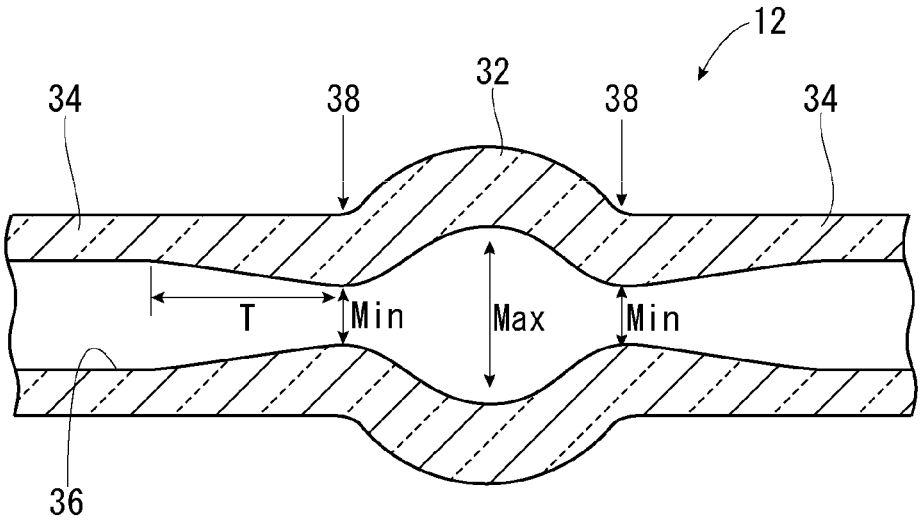
FIG. 7 is a cross-sectional view for explaining the exemplary method of manufacturing the high-pressure discharge lamp to which the present invention is applied.

Next, the sealed container 12 is prepared for inserting therein the fabricated glass-tube air-tightly sealed mounts 14. As shown in FIG. 7, the sealed container 12 has an intermediate part 32 and a pair of end parts 34. When fabrication of the high-pressure discharge lamp 10 is completed, the intermediate part 32 and the end parts 34 are designed to be formed as the luminous tube part 16 and the sealed parts 18, respectively. Each end part 34 has a cylindrical shape, and the diameter thereof is smaller than that of the intermediate part 32. The pair of end parts 34 is integrally formed with the intermediate part 32 so as to protrude therefrom. Additionally, the intermediate part 32 indicates a part that is formed between the both end parts 34 and has a larger outer contour (diameter) than the end parts 34. It should be noted that any shapes can be applied as the outer contour of the intermediate part 32, including a roughly spherical shape as applied in the present embodiment.

A communication hole 36 is bored in the sealed container 12 so as to extend from the outer end of one end part 34 to that of the other end part 34 through the interior of the intermediate part 32. Additionally, the communication hole 36 inside the intermediate part 32 is designed to have the largest diameter (in its largest diameter part Max) at a position corresponding to the center of the intermediate part 32. Moreover, the communication hole 36 inside the intermediate part 32 is designed to have a diameter gently reducing in opposite directions from the center of the intermediate part 32. Therefore, the communication hole 36 has the smallest diameter (in its smallest diameter parts Min) at positions of adjoining parts between the intermediate part 32 and the end parts 34 (hereinafter referred to as "boundary parts 38"). In other words, the sealed container 12 has the largest thickness in the boundary parts 38.

Basically, the communication hole 36 inside each end part 34 is designed to have a diameter larger than the outer diameter of each glass-tube air-tightly sealed mount 14 so as to be capable of inserting therein each glass-tube air-tightly sealed mount 14. However, as described above, each smallest diameter part Min of the communication hole 36, located at each boundary part 38 of the sealed container 12, is not limited to have the aforementioned diameter setting, and may have an arbitrary diameter as long as each electrode 26 (especially, each electrode part 26*a*) can be inserted therethrough. Additionally, the communication hole 36 has tapered parts T. Each tapered part T ranges from each smallest diameter part Min toward the outer end of each end part 34. Each tapered part T has a gently increasing diameter.

Figure 8:
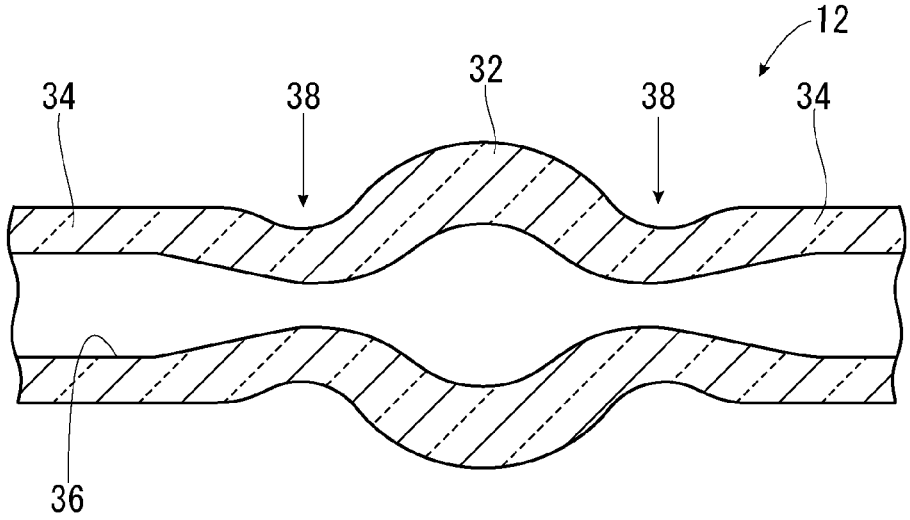
FIG. 8 is a cross-sectional view for explaining the exemplary method of manufacturing the high-pressure discharge lamp to which the present invention is applied.

Next, as shown in FIG. 8, the sealed container 12 is radially constricted at the boundary parts 38. For example, the boundary parts 38 of the sealed container 12 as described above are heated by a burner, a heater or so forth, and silica glass of which the boundary parts 38 are made are softened. After softening of the boundary parts 38, the sealed container 12 is pulled to the longitudinally opposite sides centering on each boundary part 38 so as to radially constrict the sealed container 12 at each boundary part 38.

Accordingly, at each boundary part 38 between the intermediate part 32 and each end part 34, the sealed container 12 has an outer contour formed in "a constricted shape" thinner than each end part 34. Thus, due to constriction of the sealed container 12 at the boundary parts 38, the thickness of the sealed container 12 at each boundary part 38 herein becomes thinner than that in a pre-radially constricted condition.

It should be noted that it is preferable to use, instead of the sealed container 12 shown in FIG. 8, a sealed container having a thickness designed to be smaller in the boundary parts 38 than in the intermediate part 32 and the end parts 34. The method of radially constricting the sealed container 12 is not limited to the above, and alternatively, the sealed container 12 may be radially constricted by heating the sealed container 12 at the boundary parts 38 and then squeezing (pinching) the sealed container 12 at the boundary parts 38 by an externally applied force. Yet alternatively, as a method of radially constricting the sealed container 12, it can be assumed to sandwich the boundary parts 38 with molds designed to produce the boundary parts 38 having a radially constricted shape after heating of the boundary parts 38, to press rollers onto the outer regions of the boundary parts 38, to make the boundary parts 38 shrink by heating, or to cut the outer regions of the boundary parts 38 by machining.

Figure 9:
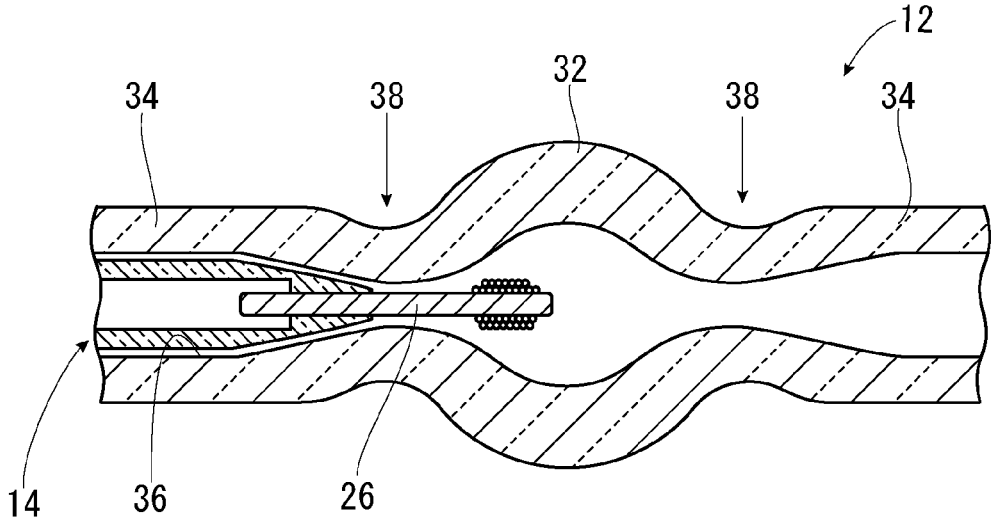
FIG. 9 is a cross-sectional view for explaining the exemplary method of manufacturing the high-pressure discharge lamp to which the present invention is applied.

As shown in FIG. 9, the glass-tube air-tightly sealed mount 14 is inserted into the communication hole 36 of thus fabricated sealed container 12, with the electrode 26 being inserted first. Positional relation between the sealed container 12 and the glass-tube air-tightly sealed mount 14 is regulated such that the tip of the electrode 26 is located in a predetermined position, and subsequently, the glass-tube air-tightly sealed mount 14 is air-tightly sealed by the end part 34 from which the glass-tube air-tightly sealed mount 14 is inserted. The aforementioned "shrink seal technique", "pinch seal technique" or so forth can be assumed as an airtight sealing method to be herein employed.

Figure 10:
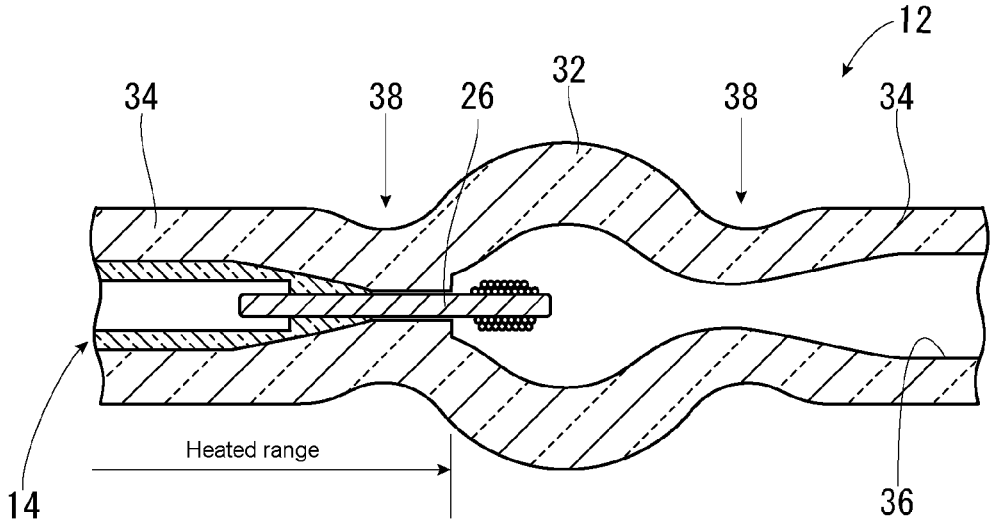
FIG. 10 is a cross-sectional view for explaining the exemplary method of manufacturing the high-pressure discharge lamp to which the present invention is applied.

Additionally, as shown in FIG. 10, it is preferable to perform heating for airtight sealing not only at a position corresponding to the glass tube 24 of each glass-tube air-tightly sealed mount 14 but also in a region ranging therefrom across the boundary part 38 to a position close to the tip of the electrode 26 within the intermediate part 32. With the configuration, the sealed container 12 can be constricted to the position closer to the tip of the electrode 26 protruding from the glass tube 24. Hence, the internal space 20 in the luminous tube part 16 of the high-pressure discharge lamp 10 can be reduced in volume.

After one of the glass-tube air-tightly sealed mounts 14 is air-tightly sealed by one of the end parts 34, the internal space 20 is filled with predetermined amounts of the mercury 50, the halogen 52, and other materials through the other side of the communication hole 36. Thereafter, the other of the glass-tube air-tightly sealed mounts 14 is air-tightly sealed by the other of the end parts 34. Based on the above, fabrication of the high-pressure discharge lamp 10 of the present embodiment is completed.

Figure 11:
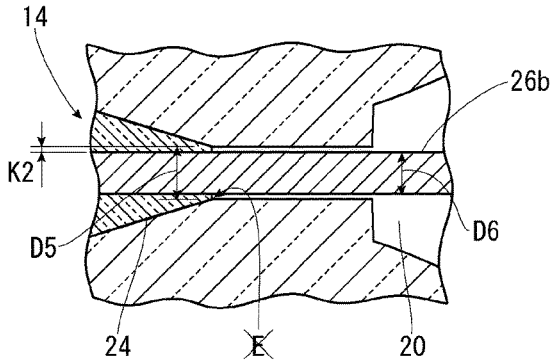
FIG. 11 is a partial enlarged cross-sectional view of the exemplary high-pressure discharge lamp to which the present invention is applied.
Figure 12:
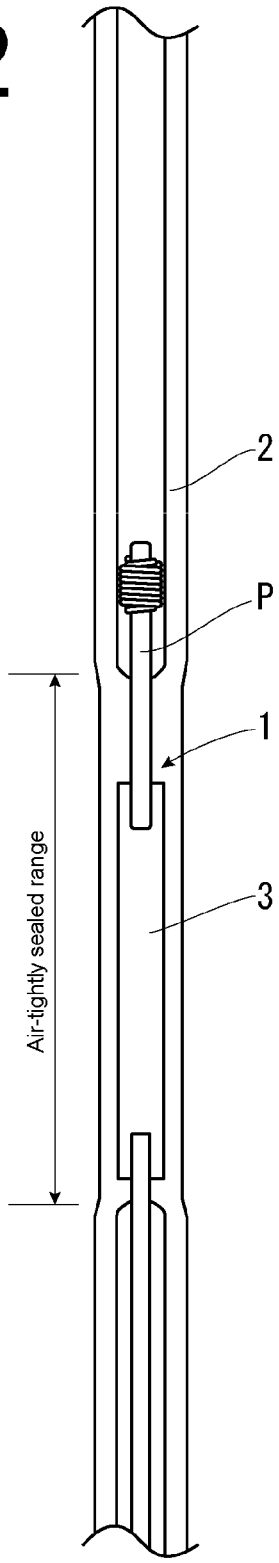
FIG. 12 is a diagram for explaining a method of manufacturing a high-pressure discharge lamp according to a related art.
Figure 13:
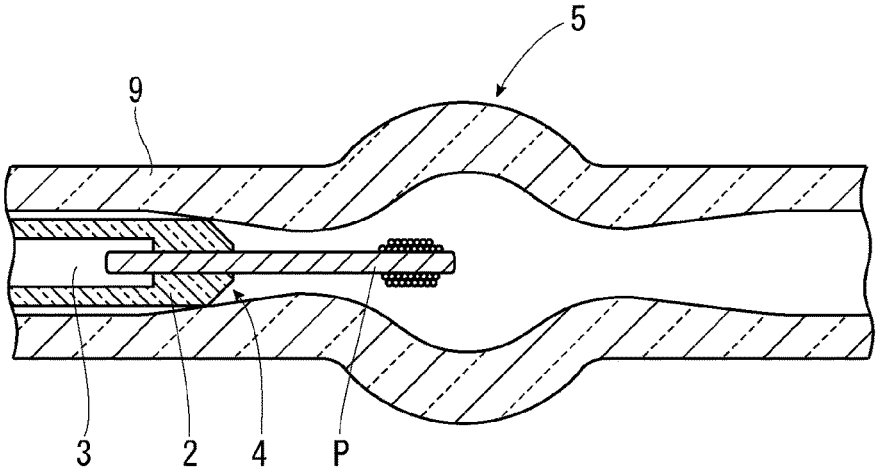
FIG. 13 is a cross-sectional view for explaining the method of manufacturing the high-pressure discharge lamp according to the related art.
Figure 14:
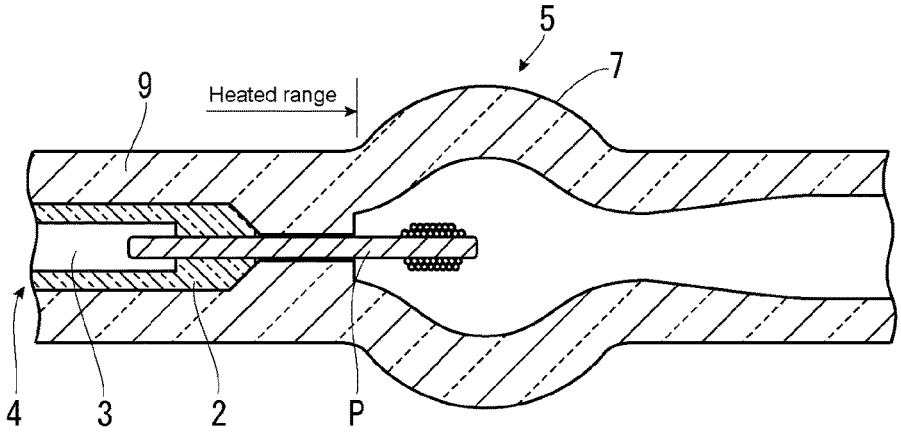
FIG. 14 is a cross-sectional view for explaining the method of manufacturing the high-pressure discharge lamp according to the related art.
Figure 15:
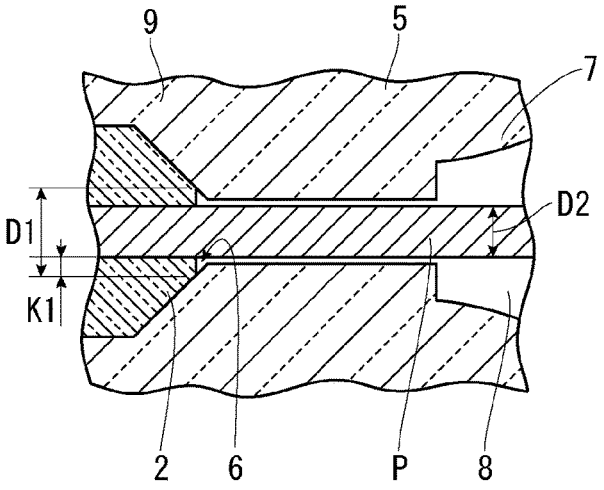
FIG. 15 is a partial enlarged cross-sectional view of the exemplary high-pressure discharge lamp according to the related art.

According to the method of manufacturing the high-pressure discharge lamp 10 according to the present embodiment, in forming each glass-tube air-tightly sealed mount 14, the glass tube 24 has been preliminarily radially constricted, and under the condition, the mount 22 is configured to be air-tightly sealed by the glass tube 24. With the configuration, as shown in FIG. 11, the diameter (D5) of the electrode 26-side end of the glass tube 24 becomes more similar to the diameter (D6) of the shaft part 26*b* of the electrode 26. Thus, a smaller step is produced between the surface of the exposed electrode 26 (the shaft part 26*b*) and the electrode 26-side end of the glass tube 24. It should be noted that in the conventional art, the distance (K1; see FIG. 15) from the surface of the shaft part of the electrode P to the outer circumference of the electrode side end of the glass tube 2 could have been maximally reduced to roughly 0.4 mm. By contrast, according to the production method of the present embodiment, the distance (K2; see FIG. 11) from the surface of the shaft part 26*b* of the electrode 26 to the outer circumference of the electrode 26-side end of the glass tube 24 can be reduced to 0.1 mm or less.

With the construction, when each glass-tube air-tightly sealed mount 14 is inserted into the sealed container 12 and is air-tightly sealed by a region ranging from one end part 34 to a part of the intermediate part 32 in the sealed container 12, an edge E (an internal corner) is unlikely to be produced between the electrode 26-side end surface of the glass tube 24 and the surface of the communication hole 36. Suppose the edge E is produced, sealing of the sealed part 18 could be broken because the edge E herein becomes a structural origin of breakage. In other words, in terms of pressure proofing, the edge E could be a defective part in the internal space 20 of the luminous tube part 16 of the high-pressure discharge lamp 10.

Additionally, as with the present embodiment, when the glass tube 24 is heated and then pulled to the longitudinally opposite sides centering on the first position F so as to be radially constricted, the electrode 26-side end part of the glass tube 24 has a longer tapered part, a smoother surface and a sharper shape in comparison with a conventional glass tube.

With the construction, the smooth surface of the electrode 26-side end part of the glass tube 24 and the surface (which is also smooth) of the communication hole 36 of the sealed container 12 are better fitted in airtight sealing, and thus, adhesiveness between the both surfaces is further enhanced.

Therefore, according to the method of manufacturing the high-pressure discharge lamp 10 of the present embodiment, a possibility of producing the edge E that could be a defective part in terms of pressure proofing is reduced, and simultaneously, adhesiveness is enhanced between the surface of the communication hole 36 of the sealed container 12 and the surface of the electrode 26-side end part of the glass tube 24. Therefore, it is possible to manufacture the high-pressure discharge lamp 10 that is enhanced in airtightness of the internal space 20 of the luminous tube part 16 and thus enables lighting at a higher pressure.

Moreover, in the present embodiment, each boundary part 38 of the sealed container 12 has been preliminarily radially constricted, and then, the thickness of the sealed container 12 is configured to be reduced at each boundary part 38. With the configuration, when each glass-tube air-tightly sealed mount 14 is inserted into the communication hole 36 of the sealed container 12 and is then air-tightly sealed by the sealed container 12, it is possible to reduce a period of time required for heating the sealed container 12 (especially, for heating a region of the sealed container 12 that corresponds to the vicinity of the electrode 26-side end of the glass tube 24). Additionally, the heating time can be further reduced by more thinly forming the thickness of each radially constricted boundary part 38 than the thickness of the intermediate part 32 and that of each end part 34.

By thus reducing the heating time for the sealed container 12 in airtight sealing, a possibility of producing a crack in an air-tightly sealed part due to thermal effect can be reduced as much as possible. Furthermore, when the heating time is set to be equal to the conventional heating time, each glass-tube air-tightly sealed mount 14 can be air-tightly sealed by a region ranging to a position closer to the tip of the electrode 26 in the sealed container 12, and in other words, the internal space 20 can be reduced in volume. Accordingly, "base of electrode" parts, which are located farthest from a gap (an arc point) between the pair of electrodes and have the lowest temperature in the internal space 20 during lighting, are reduced in volume. Hence, the average temperature of the internal space 20 during lighting can be increased, and simultaneously, the temperature at the coldest points in the internal space 20 can be increased as much as possible. Consequently, a larger amount of luminescence can be obtained by evaporating a larger amount of the mercury 50 in the internal space 20.

It should be understood that the embodiments herein disclosed in the present application are illustrative only and are not restrictive in all aspects. It is intended that the scope of the present invention is indicated by the appended claims rather than the aforementioned explanation, and encompasses all the changes that come within the meaning and the range of equivalents of the appended claims.

The disclosure of Japanese Patent Application No. 2014-143755 filed Jul. 12, 2014 including specification, drawings and claims is incorporated herein by reference in its entirety.

What is claimed is:

1. A method of manufacturing a high-pressure discharge lamp, comprising the steps of:

forming a mount including a metallic foil, an electrode and an external lead rod by welding the electrode to one end of the metallic foil and welding the external lead rod to the other end of the metallic foil;

inserting the mount into an interior of a glass tube having an outer diameter smaller than an inner diameter of an end part of a sealed container;

radially constricting the glass tube at a first position located away from the metallic foil toward a tip of the electrode;

air-tightly sealing the mount by a region of the glass tube after the step of radially constricting is completed, the region ranging from the first position to at least the other end of the metallic foil;

protruding the electrode out of the glass tube located away from the first position toward the tip of the electrode so as to form a glass-tube air-tightly sealed mount;

inserting the glass-tube air-tightly sealed mount into the end part of the sealed container such that the tip of the electrode is inserted first; and radially constricting the end part so as to air-tightly sealing the glass tube of the glass-tube air-tightly sealed mount by the end part.

2. The method according to claim 1, wherein the step of radially constricting the glass tube results in formation of a smooth tapered surface on an electrode-side end part of the glass tube air-tightly sealing the glass-tube air-tightly sealed mount.

3. The method according to claim 1, wherein in the step of radially constricting the glass tube, the glass tube is heated at the first position and is pulled to longitudinally opposite sides centering on the first position.

4. The method according to claim 1, wherein the sealed container has a pair of end parts and an intermediate part that is formed between the end parts and has a larger outer contour than the end parts, and boundary parts between the end parts and the intermediate part respectively have an outer contour more thinly constricted than the end parts.

5. The method according to claim 4, wherein the boundary parts respectively have a smaller thickness than the remaining part of the sealed container.

6. The method according to claim 4, wherein the boundary parts of the sealed container are respectively more reduced in thickness than the remaining part of the sealed container by heating the boundary parts and pulling the sealed container to longitudinally opposite sides at each of the boundary parts.

7. The method according to claim 4, wherein in the step of radially constricting the end part of the sealed container so as to air-tightly sealing the glass tube of the glass-tube air-tightly sealed mount by the end part, the sealed container is radially constricted to the intermediate part across the boundary part.

8. The method according to claim 1, wherein the step of radially constricting the glass tube results in reducing the radial thickness of the glass tube at the first position.

* * * * *